US005794301A

United States Patent [19]

Hietala

[11] Patent Number: 5,794,301

[45] Date of Patent: Aug. 18, 1998

[54] WASHER FOR FOLDING CHAIRS

[76] Inventor: John C. Hietala, 92 Old Meeting House La., Norwell, Mass. 02061

[21] Appl. No.: 762,767

[22] Filed: Dec. 10, 1996

[51] Int. Cl.[6] ..... A46B 11/00; B08B 3/00; A47L 13/26

[52] U.S. Cl. ..... 15/104.92; 15/160

[58] Field of Search ..... 15/104.92, 160

[56] References Cited

U.S. PATENT DOCUMENTS 2,744,276 5/1956 Chambless ..... 15/104.92
4,380,839 4/1983 Caradonna ..... 15/104.92
5,404,610 4/1995 Coyer, Sr. et al. ..... 15/104.92

FOREIGN PATENT DOCUMENTS 7810153 5/1979 Netherlands ..... 15/160

*Primary Examiner*—Mark Spisich
*Attorney, Agent, or Firm*—John P. McGonagle

[57] ABSTRACT

A folding chair washer comprised of a frame with several vertically arranged sets of linear, horizontal brushes, the brushes in each set being placed opposite each other. The frame, with attached sets of brushes is inserted into a container holding either a cleaning fluid or a rinsing fluid.

12 Claims, 6 Drawing Sheets

WASHER FOR FOLDING CHAIRS

BACKGROUND OF THE INVENTION

This invention relates to apparatus for cleaning chairs, and in particular to a washing apparatus for cleaning folding chairs.

Folding chairs are chairs that fold to an essentially flat configuration, usually by lifting the front of the seat from a horizontal unfolded position to a vertical folded position as the legs pivot with respect to each other. Folding chairs are often used in large numbers, i.e., hundreds and thousands, for events such as graduation ceremonies, weddings, concerts, and the like. At these events, foreign matter can soil the chairs. Foreign matter may be comprised of and minimally includes food and beverages, fingerprints, scuff marks, dirt, mud, bird droppings, tree sap, grass and grass stains, and so on. The chairs must be cleaned before reuse. This may require a significant effort, especially if a large number of chairs is involved or if the chairs must be cleaned between use at closely-timed events.

In the past, folding chairs typically have been cleaned manually, i.e., by a worker with a brush and hose. This is a labor intensive process. The chairs are either cleaned at the event location or brought to a central location, such as a rental agency or warehouse, where they are cleaned before reuse.

Applicant is unaware of any simple apparatus for cleaning folding chairs. U.S. Pat. No. 5,231,726 discloses an automatic folding chair cleaner comprised of a housing with a channel running from one end of the housing to the other, a conveyor within said housing for moving a chair through the housing, two cylindrical scrubbers with corresponding cleaning fluid nozzles for removing foreign matter from the chair, and a pair of rinsing fluid nozzles. Other than this patent, applicant is unaware of any other prior art attempts to address the problem of cleaning folding chairs quickly.

To be effective, a folding chair cleaning apparatus must be portable so that it can be brought to various sites where the chairs are located and/or have been used. The cleaning apparatus disclosed by the above referenced patent is elaborate, bulky, and expensive. It also requires an external pressurized source of water as well as electrical power to run the apparatus. Pressurized sources of water and external electrical power are not always available.

SUMMARY OF THE INVENTION

In view of the foregoing, the present invention provides a washer for folding chairs. As such, the general purpose of the present invention, which will be described subsequently in greater detail, is to provide a portable washing apparatus for folding chairs which does not require an external electrical power source nor an external source of pressurized water.

To attain this, the present invention provides a frame with several vertically arranged sets of linear, horizontal brushes, the brushes in each set being placed opposite each other. The frame, with attached sets of brushes is inserted into a container holding either a cleaning fluid or a rinsing fluid. Each folded chair to be cleaned is manually pushed down into the frame between the sets of brushes and then pulled back upward and removed. The movement of the chair between the sets of brushes causes a scrubbing effect on the chair by the brushes thereby removing foreign matter from the chair.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
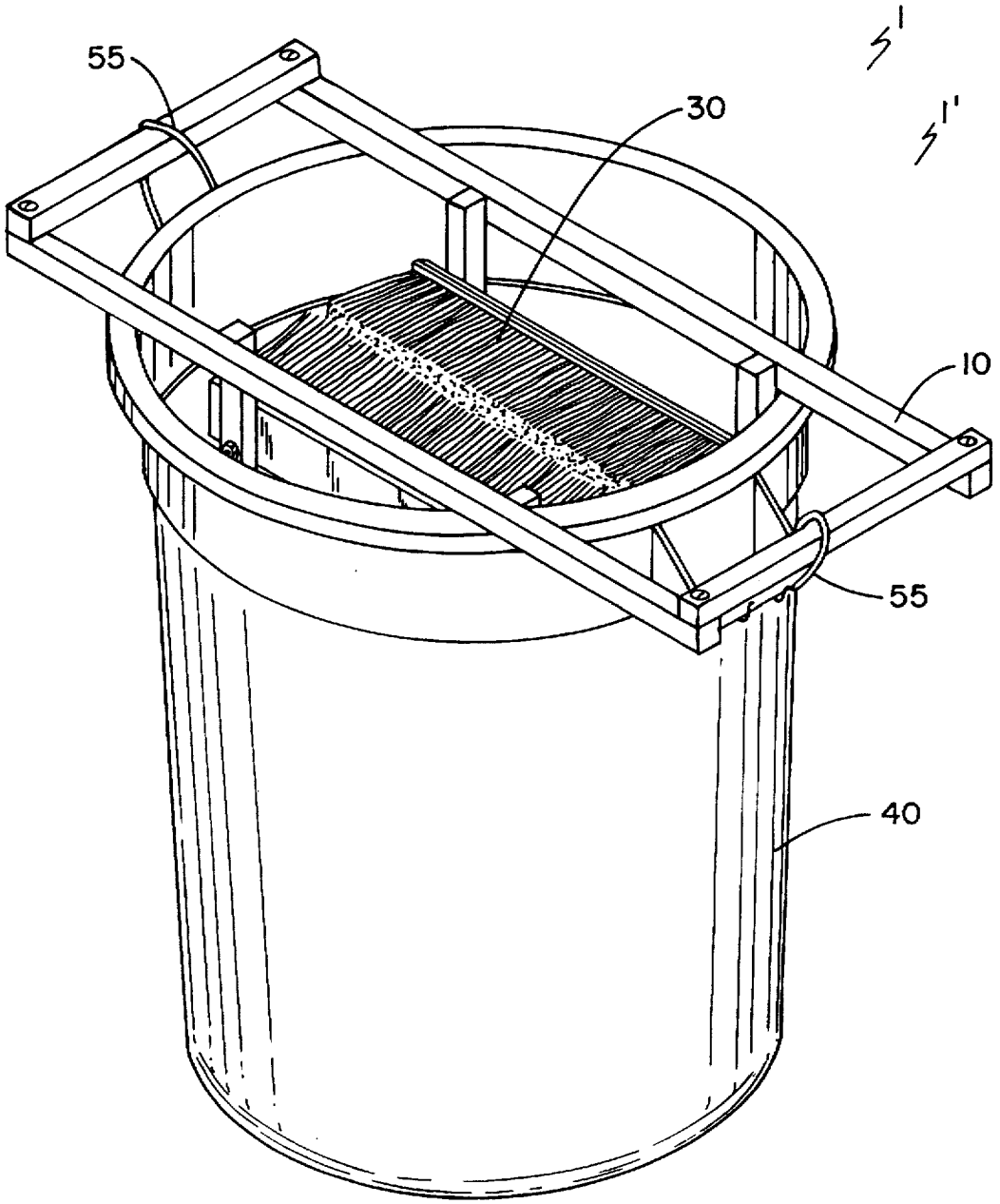
FIG. 1 is a perspective view of the invention.
Figure 2:
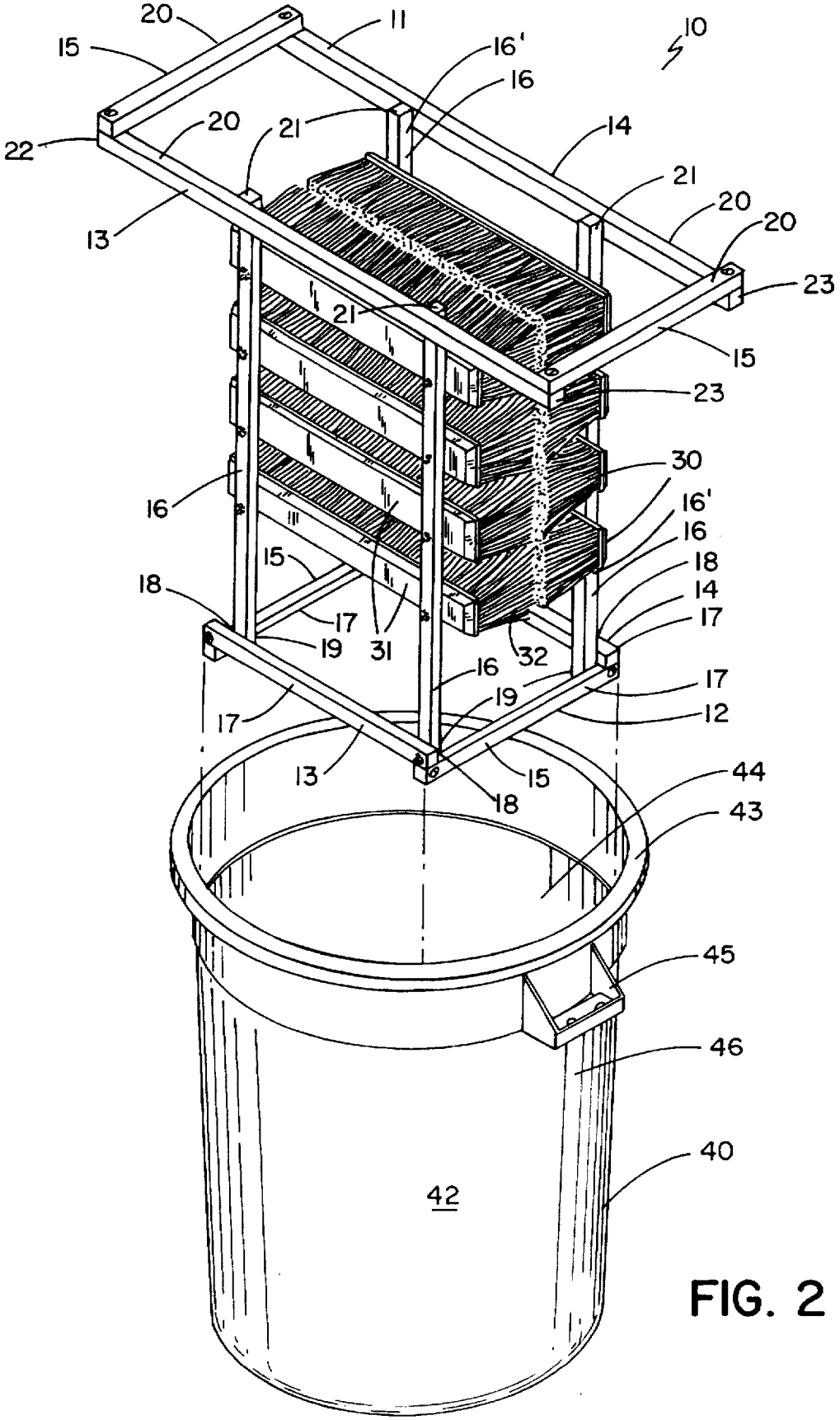
FIG. 2 is a partly exploded view of the invention shown in FIG. 1.
Figure 4:
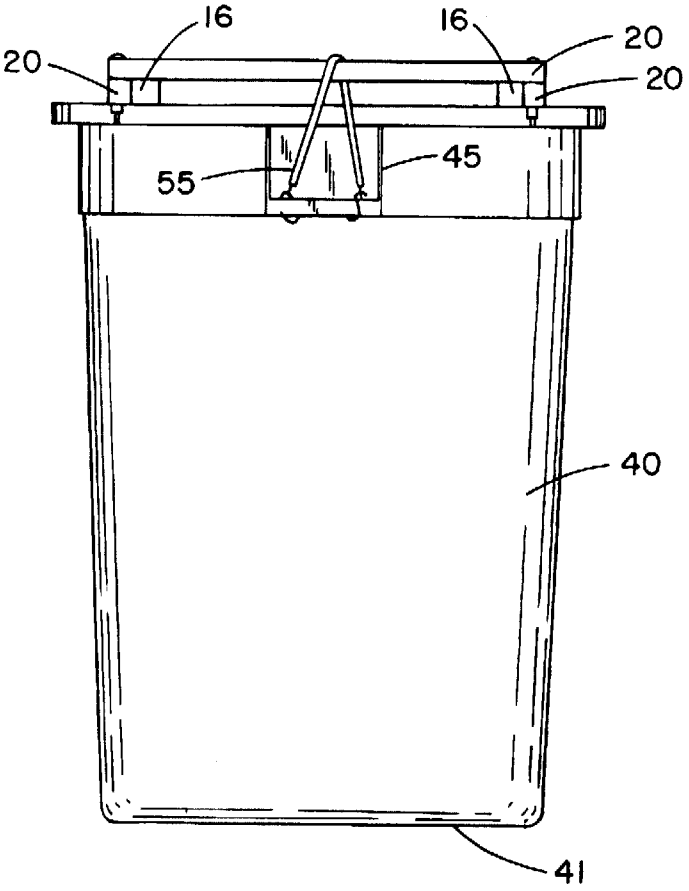
FIG. 4 is a side elevational view of the invention of FIG. 1.
Figure 3:
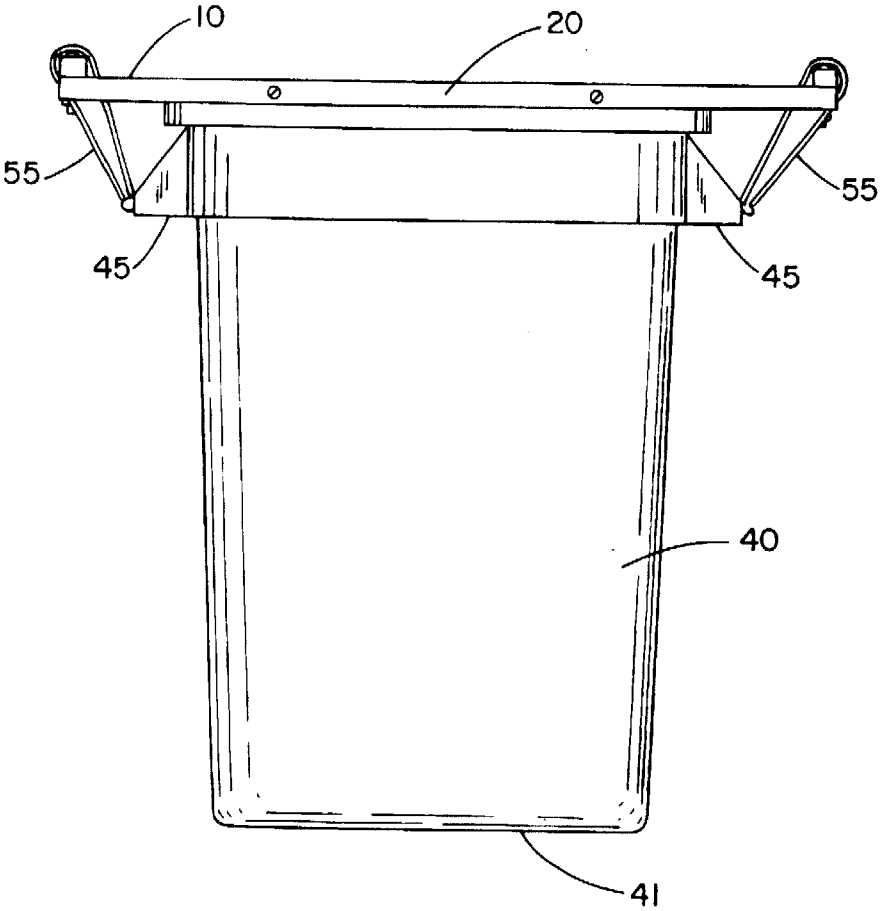
FIG. 3 is a front elevational view of the invention of FIG. 1.
Figure 6:
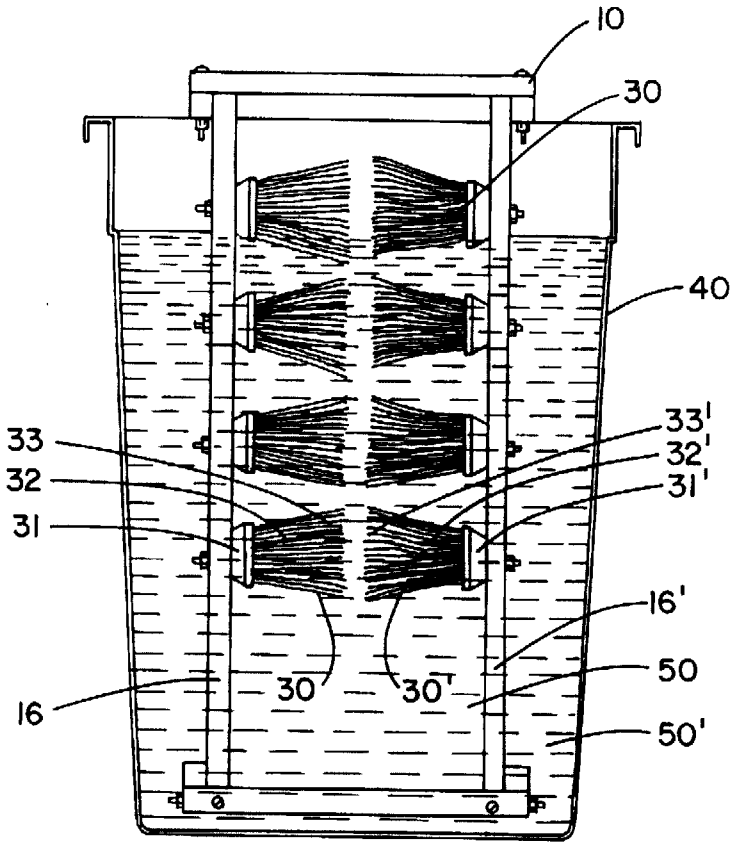
FIG. 6 is a side plan view of the invention of FIG. 4.
Figure 5:
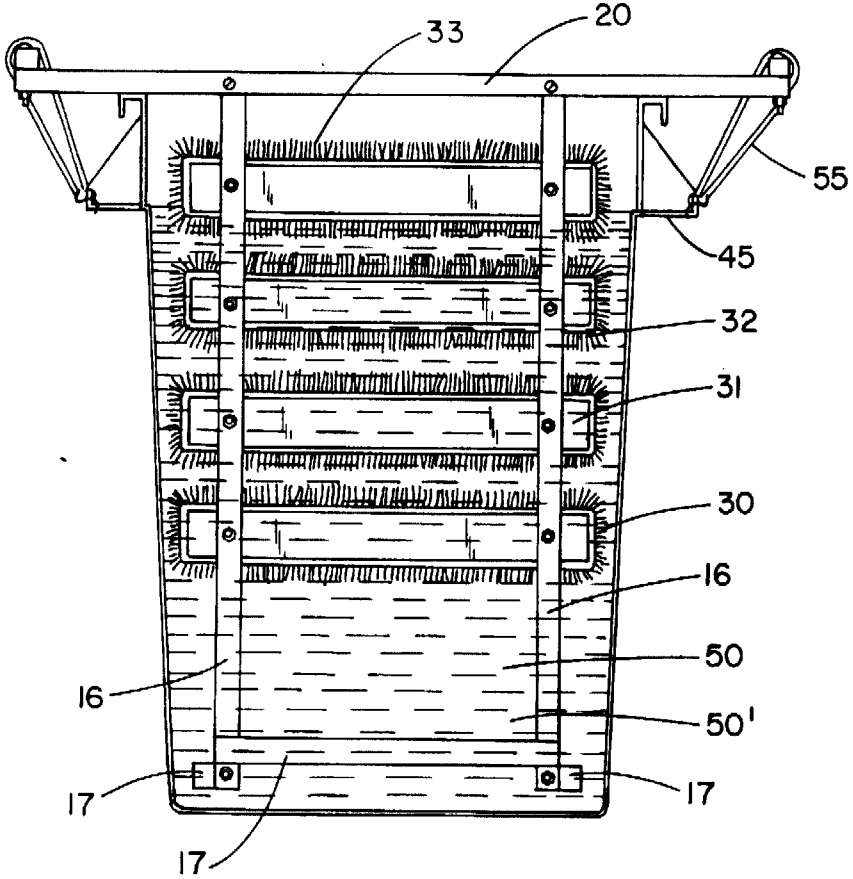
FIG. 5 is a front plan view of the invention of FIG. 3.
Figure 8:
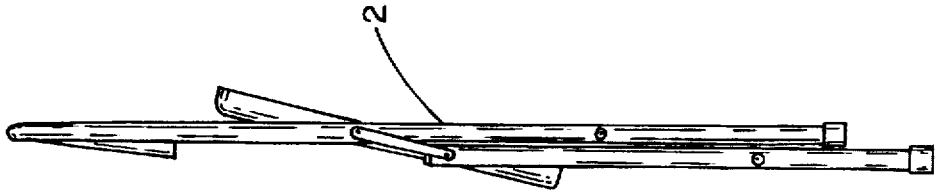
FIG. 8 is a side elevational view of a folding chair in a fully closed (folded) position.
Figure 7:
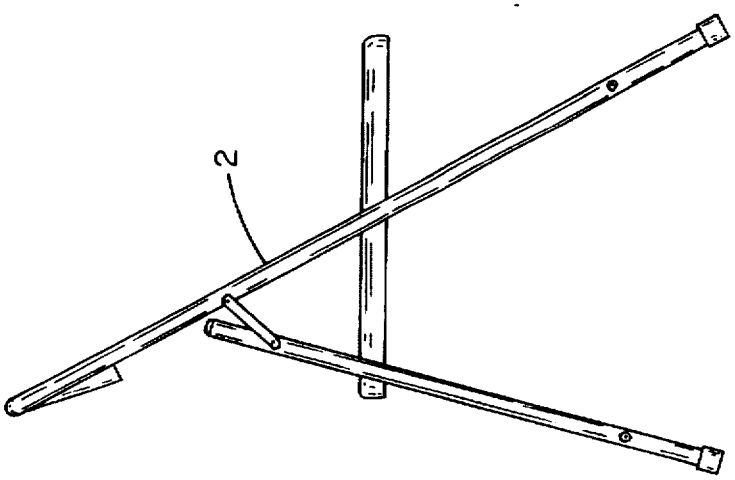
FIG. 7 is a side elevational view of a folding chair in a fully open position.
Figure 9:
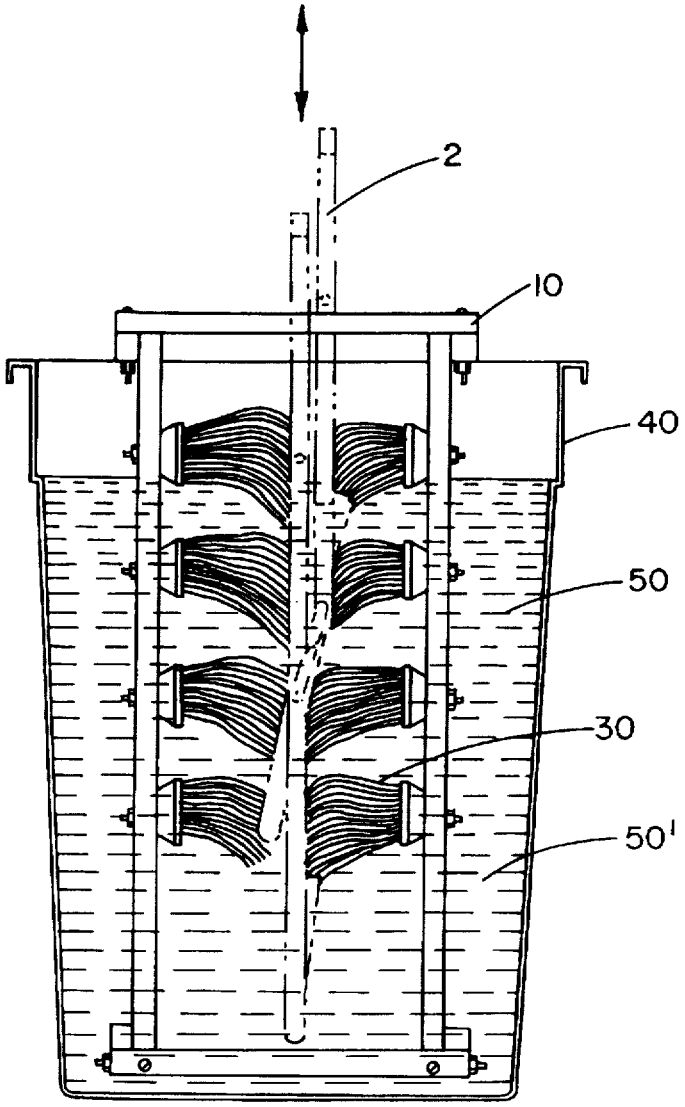
FIG. 9 is the view shown in FIG. 6 with the folded chair of FIG. 8 being cleaned in the invention.

Referring to the drawings in detail wherein like elements are indicated by like numerals, there is shown an embodiment of the invention 1 incorporating a washer for folding chairs. FIG. 7 illustrates a typical folding chair 2 deployed in a fully open position. FIG. 8 illustrates the same chair 2 in a fully closed (folded) position. Referring to the remaining drawings, the invention 1 is comprised of a frame assembly 10 inserted into a container 40. As may be most clearly seen from FIG. 9, a folded chair 2 is inserted into the frame assembly 10 positioned within the container 40.

The frame assembly 10 has a top 11, bottom 12, front 13, rear 14, and two sides 15. The frame assembly 10 is further comprised of four vertical, struts 16 extending from the frame assembly bottom 12 to the frame assembly top 11, each strut 16 positioned in parallel to the other struts 16. The frame assembly bottom 12 is comprised of four bottom horizontal elements 17 interconnecting the struts 16, wherein one bottom horizontal element 17 is positioned along the frame assembly front 13, one element 17 along the rear 14, and one element 17 along each frame assembly side 15. The four bottom horizontal elements 17 form a generally rectangular configuration with a strut bottom 19 joined at each horizontal element configuration corner 18.

The frame assembly top 11 is comprised of four top horizontal elements 20, wherein one top horizontal element 20 is positioned along the frame assembly front 13 and is attached to the two front strut tops 21, one element 20 is positioned along the frame assembly rear 14 and is attached to the two rear strut tops 21, and one element 20 is positioned along each frame assembly side 15 interconnecting the left 22 and right 23 ends of the front and rear top horizontal elements 20. The four top horizontal elements 20 form a generally rectangular configuration with a longitudinal axis extending parallel to the front and rear top horizontal elements 20. The strut tops 21 are connected to the front and rear top horizontal elements 20 approximately one quarter of the top horizontal element longitudinal distance from each element end 22, 23.

The frame assembly 10 has four vertically arranged sets of linear, horizontal brushes 30, the brushes 30 in each set being placed opposite each other. Each brush has a solid horizontal backing 31 with a substantial number of bristles 32 protruding therefrom. Each set of brushes 30 is connected to the frame assembly 10 as follows. One brush 30 in a two-brush set is horizontally attached by means of its backing 31 to the two front struts 16 so that the bristles 32 extend toward a plane defined by the two rear struts 16'. The other brush 30' in a two-brush set is horizontally attached by means of its backing 31' to the two rear struts 16' so that the bristles 32' extend toward a plane defined by the two front struts 16. The bristle front tips 33, 33' may touch or may be spaced a defined distance depending upon the degree of scrubbing action desired. In this embodiment of the invention, four sets of brushes 30 are used. More or less sets of brushes may be used.

The frame assembly 10, with attached sets of brushes 30 is inserted into a container 40 holding either a cleaning or a rinsing fluid 50. The container 40 has a horizontal bottom 41 from which cylindrical side walls 42 extend vertically upward, said walls 42 defining a hollow interior 44. The container 40 is generally cylindrical in shape, the longitudinal axis of said container 40 being generally perpendicular to the bottom 41 of the container 40. The container side walls 42 rise upward from the container bottom 41 and terminate in a rim 43 defining an open top of the container 40. The lengths of the front and rear top horizontal elements 20 exceed the diameter of the container 40. The frame assembly 10 is inserted through the container open top into the container hollow interior 44. The frame assembly front and rear top horizontal elements 20 rest on the container rim 43. Tie-down straps 55 may be tied around the top horizontal side elements 20 through handles 45 attached to the exterior surface 46 of the container side walls 42. A cleaning or rinsing solution 50 is poured through the container open top into the container interior 44.

In operation, the frame assembly 10 with attached sets of brushes 30 is inserted into the container 40 holding either a cleaning or a rinsing fluid 50. The frame assembly 10 is secured to the container 40 by means of tie-down straps 55. Each folded chair 2 to be cleaned is manually pushed down through the frame assembly top 11 between the sets of brushes 30 and then pulled back upward and removed. The movement of the chair 2 between the brush bristle tips 33 causes a scrubbing effect on the chair 2 thereby removing foreign matter from the chair 2 being cleaned. Two washers 1, 1' may be operated side-by-side, wherein one washer 1 contains cleaning fluid 50 and the other washer 1' rinsing fluid 50'.

It is understood that the above-described embodiment is merely illustrative of the application. Other embodiments may be readily devised by those skilled in the art which will embody the principles of the invention and fall within the spirit and scope thereof.

I claim:

1. A washer for folding chairs, comprising:

a container holding a fluid;

a frame assembly inserted into said container, said frame assembly having a top, bottom, front, rear, two sides and four vertical struts extending from the frame assembly bottom to the frame assembly top, two of said struts being positioned at the frame assembly front and two of said struts being positioned at the frame assembly rear, each said vertical strut having a top and a bottom, each said vertical strut being positioned in parallel to the other vertical struts, said frame assembly having a plurality of vertically arranged sets of linear, horizontal brushes attached to said vertical struts, the brushes in each set being placed opposite each other, said frame assembly being adapted to receive a folded chair.

2. A washer for folding chairs as recited in claim 1, wherein:

said container has a horizontal bottom from which side walls extend vertically upward, said walls defining a hollow interior, the container having a longitudinal axis generally perpendicular to the bottom of the container, said side walls rising upward from the container bottom and terminating in a rim defining an open top of the container, said side walls having an interior surface and an exterior surface.

3. A washer for folding chairs as recited in claim 2, wherein:

said frame assembly bottom is comprised of four bottom horizontal elements interconnecting the vertical strut bottoms, wherein one bottom horizontal element is positioned along the frame assembly front, one element along the rear, and one element along each frame assembly side; and said frame assembly top is comprised of four top horizontal elements, each said top horizontal element having two ends, wherein one top horizontal element is positioned along the frame assembly front and is attached to the two front strut tops, wherein another top horizontal element is positioned along the frame assembly rear and is attached to the two rear strut tops, wherein each of the two remaining top horizontal elements are positioned along each frame assembly side interconnecting the front and rear top horizontal elements, said four top horizontal elements forming a generally rectangular configuration having a longitudinal axis extending parallel to the front and rear top horizontal elements.

4. A washer for folding chairs as recited in claim 3, wherein:

said strut tops are connected to the front and rear top horizontal elements approximately one quarter of the top horizontal element longitudinal distance from each top horizontal element end.

5. A washer for folding chairs as recited in claim 4, wherein:

each said brush has a solid horizontal backing with a substantial number of bristles protruding therefrom.

6. A washer for folding chairs as recited in claim 5, wherein:

each set of brushes is comprised of two brushes, one brush in a set being horizontally attached by means of its backing to the two front struts and adapted so that its bristles extend toward a plane defined by the two rear struts, the other brush in a set being horizontally attached by means of its backing to the two rear struts and adapted so that its bristles extend toward a plane defined by the two front struts.

7. A washer for folding chairs as recited in claim 6, wherein:

the front and rear top horizontal elements have lengths which exceed a diameter of the container.

8. A washer for folding chairs as recited in claim 7, wherein:

said frame assembly is inserted through the container open top into the container hollow interior.

9. A washer for folding chairs as recited in claim 8, wherein:

said frame assembly front and rear top horizontal elements rest on the container rim.

10. A washer for folding chairs as recited in claim 9, further comprising:

a plurality of tie-down straps tied around the top horizontal side elements through handles attached to the exterior surface of the container side walls.

11. A washer for folding chairs as recited in claim 10, wherein:

said fluid is a cleaning or rinsing solution poured through the container open top into the container interior.

12. A washer for folding chairs as recited in claim 11, wherein:

said container has a generally cylindrical shape.

* * * * *